United States Patent [19]

Moore, Jr. et al.

[11] Patent Number: 4,925,093

[45] Date of Patent: May 15, 1990

[54] FORCED DRAFT DIRECT VENT SYSTEM FOR A WATER HEATER

[75] Inventors: Henry J. Moore, Jr., Playa Del Ray; Wouter J. Wiersma, Arcadia, both of Calif.

[73] Assignee: Mor-Flo Industries, Inc., Cleveland, Ohio

[21] Appl. No.: 268,716

[22] Filed: Nov. 9, 1988

[51] Int. Cl.[5] ..... F24D 3/08; F24H 1/22

[52] U.S. Cl. ..... 237/19; 122/13 R; 122/17; 126/360 R; 236/15 C; 431/19; 431/38

[58] Field of Search ..... 431/19, 38, 12; 122/13 R, 17; 237/19; 126/360 R, 360 A; 236/15 C

[56] References Cited

U.S. PATENT DOCUMENTS

| | | | |
|---|---|---|---|
| 1,643,859 | 9/1927 | Sauvage . | |
| 1,707,281 | 4/1929 | Sauvage . | |
| 1,713,442 | 5/1929 | Matcovich . | |
| 1,826,748 | 10/1931 | Delamere . | |
| 2,348,950 | 5/1944 | Anderson | 236/45 |
| 2,385,854 | 10/1945 | Wolfersperger | 158/99 |
| 3,280,774 | 10/1966 | English | 110/162 |
| 3,741,710 | 6/1973 | Nelson | 431/90 |
| 3,756,221 | 9/1973 | Patycola | 126/360 R |
| 3,759,230 | 9/1973 | Cooksley | 122/156 |
| 4,204,832 | 5/1980 | Miller | 431/20 |
| 4,262,608 | 4/1981 | Jackson | 110/162 |
| 4,303,042 | 12/1981 | Sumiyoshi | 122/17 |
| 4,397,296 | 9/1983 | Moore, Jr. et al. | 126/360 |
| 4,488,537 | 12/1984 | Laurent | 126/360 R |
| 4,549,525 | 10/1985 | Narang | 126/361 |
| 4,641,631 | 2/1987 | Jatana | 126/101 |
| 4,660,541 | 4/1987 | Moore | 126/360 |
| 4,664,096 | 5/1987 | Narang | 126/351 |
| 4,672,919 | 6/1987 | Staata | 122/13 R |
| 4,766,883 | 8/1988 | Cameron et al. | 126/360 R X |

OTHER PUBLICATIONS

Brochure, State Industries, Inc.

Brochure, "BGP Systems" Heatmaker, copyright 1981 by BGP Systems, Inc.

Brochure, "AMT Heat Maker"—DN2600-707.

*Primary Examiner*—Edward G. Favors

*Attorney, Agent, or Firm*—Body, Vickers & Daniels

[57] ABSTRACT

A forced draft direct vent system is provided for an indoor domestic type gas water heater having an atmospheric burner. The forced draft system permits adaptation of the water heater as a combined water heater and space heater in a compact continuous upright arrangement of components.

25 Claims, 3 Drawing Sheets

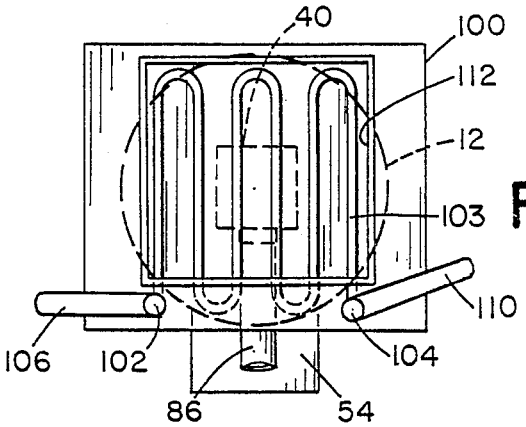
FIG. 7
FIG. 5
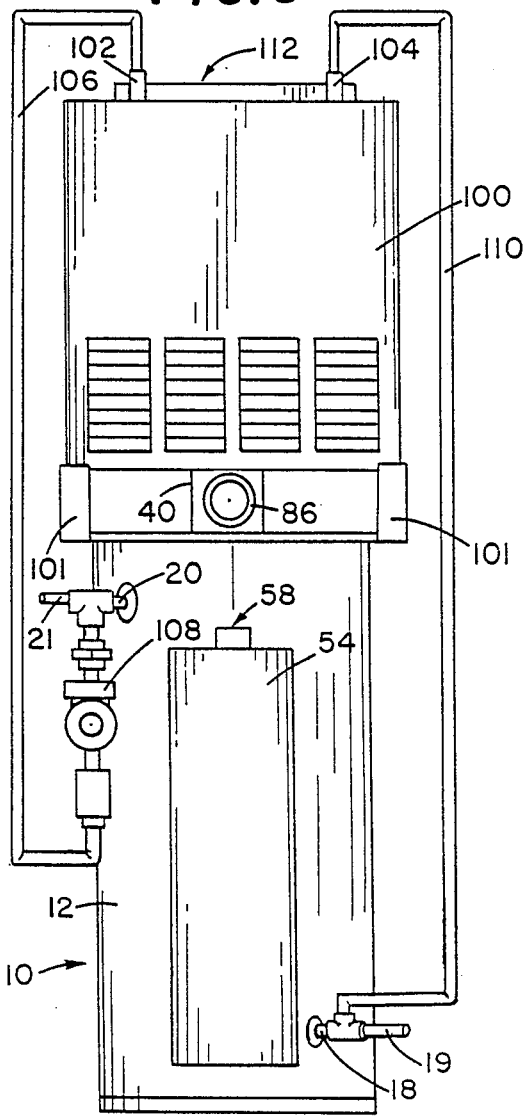
FIG. 6
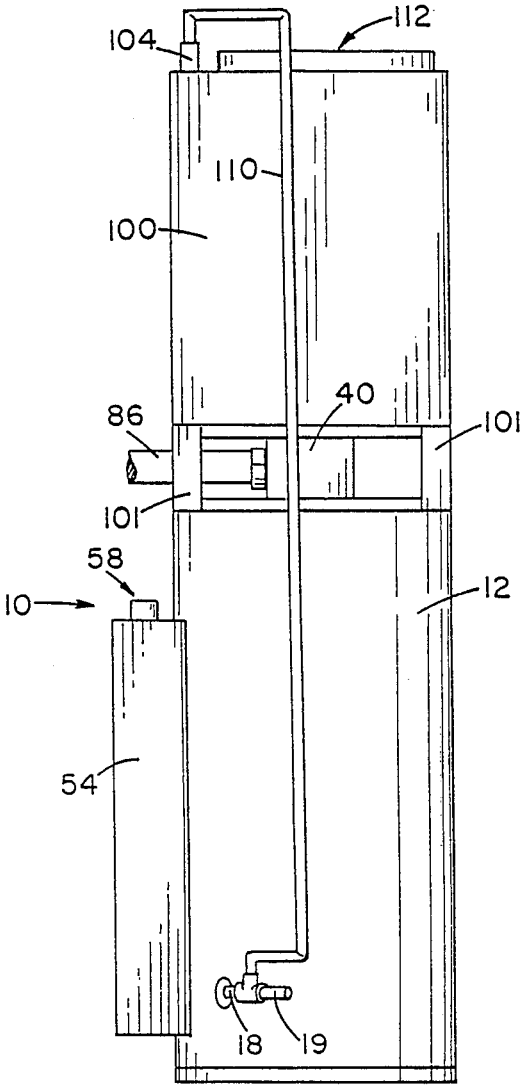

FORCED DRAFT DIRECT VENT SYSTEM FOR A WATER HEATER

The present invention pertains to the art of water heaters, and particularly to a forced draft direct vent water heater of the indoor domestic type having an atmospheric burner.

BACKGROUND OF THE INVENTION

Indoor water heaters of the domestic type usually comprise an upright generally cylindrical body including a tank for holding a quantity of water to be heated. A burner for natural gas or other gaseous fuel is disposed within a combustion chamber which is associated with the lower region of the water heater tank to conduct the heat of combustion to the water contained in the tank. The combustion chamber includes a combustion air inlet opening and a flue gas outlet opening. A flue pipe extends from the flue gas outlet opening to a position at the exterior of the water heater body where a connection is made between the flue pipe and a chimney or other passageway leading to the outdoor atmosphere. The flue pipe usually extends through the tank of water in order to conduct additional heat into the water from the flue gases.

A particular type of water heater employs an atmospheric burner to provide the heat of combustion at the combustion chamber. An atmospheric burner is an assembly at the terminal end of a fuel supply pipe which includes an air inlet and one or more flame apertures downstream from the air inlet. The flow of gaseous fuel to the burner draws surrounding atmospheric combustion air through the inlet to produce a mixture therewith which is ignited to burn upon exiting a flame aperture. The air inlet is often adjustable by rotation of a slotted disc or sleeve over an opening in the fuel supply pipe. In a water heater, the air inlet portion of the atmospheric burner defines in whole or in part the combustion air inlet opening which communicates the combustion chamber with the atmosphere of the room in which the heater is located. The flue pipe in such heaters extends vertically from the flue gas outlet opening at the combustion chamber directly to an open end at the top of the water heater body. A conical vent hood having an upper and lower open end is supported on brackets in a position raised above the top surface of the water heater body and received coaxially over the open end of the flue pipe to define an open annular space between the flue pipe and the lower end of the conical vent hood. The upper end of the vent hood is connected to a conduit leading to a chimney or other access to the outdoor atmosphere.

Combustion of the gaseous fuel at the atmospheric burner derives necessary oxygen from the combustion air surrounding the burner. Operation of the water heater is vented by means of a natural draft developed by the heat of combustion at the atmospheric burner. Room air is drawn into the combustion air inlet opening at the combustion chamber as the heat of combustion causes flue gases and heated combustion air to flow through the flue gas outlet opening and upwardly through the flue pipe to the chimney connection.

Atmospheric burner water heaters of this type suffer from several disadvantages. The greatest disadvantage arises in the use of room air for combustion air at the burner. Use of room air inefficiently wastes the energy expended to heat, cool, or humidify that air since it is wastefully driven out of the building with the exhaust of flue gases. A further loss of room air occurs through the open arrangement of the vent hood over the flue pipe which permits room air to pass through the annular space therebetween and upwardly to the chimney with the rising flue gases. Another disadvantage is that the heated interior components of the water heater cause a residual convective flow to proceed through the water heater between intermittent operations of the burner. This not only wastes room air being drawn in through the combustion chamber inlet opening, but also wastes heat which is consequently drawn out of the heated components and the stored quantity of water by the residual convective flow. Furthermore, a draft of room air out of the building through the water heater tends to cause a corresponding draft of outdoor air into the building through cracks or other spaces in door and window frames to further disrupt heating or air conditioning systems.

Another type of domestic indoor water heater employs a power burner to provide the heat of combustion. A power burner is a device for providing a mixture of gaseous fuel and combustion air which is calculated to increase the efficiency of fuel consumption. A water heater system employing a power burner generally comprises a fluid pressure regulating device, a gas valve adapted to direct a pressurized flow of fuel from a source to the pressure regulating device, and a centrifugal blower in a housing adapted to cause a pressurized flow of combustion air into the pressure regulating device. The pressure regulating device is adapted to provide a predetermined mixture of fuel and air and has an outlet therefor leading into the combustion chamber of the water heater. The flue pipe in such heaters may extend from the combustion chamber outlet opening through the tank of water in either a straight or an non-linear configuration to a position at the exterior of the water heater where a connection is made to a chimney or conduit extending to the outdoor atmosphere. A combustion air inlet conduit may be provided to extend from the outdoor atmosphere to the combustion chamber inlet opening to complete a direct vent system which vents the combustion chamber to the outdoor atmosphere in isolation from indoor room air.

Operation of a power burner water heater system commences when a water temperature thermostat signals the gas valve to supply fuel to the power burner. The centrifugal blower usually begins to supply combustion air to the power burner in response to the flow of gaseous fuel. As the mixture of air and fuel is burned, the system is vented by the force of air pressure induced by the centrifugal blower. The blower may be placed downstream from the combustion chamber in line with the expulsion of flue gases, in which case it is referred to as an induced draft blower, or it may be placed upstream of the combustion chamber in line with the incoming combustion air, in which case it is termed a forced draft blower. In either case, the blower is arranged to direct a flow of combustion air to the power burner system, and a corresponding flow of flue gases and heated combustion air from the combustion chamber through the flue pipe and the outlet conduit to the outdoor atmosphere.

Water heaters having power burners also suffer from several disadvantages. A complex control system is required to cause the thermostat to operate the gas valve, and to cause the blower to operate in response to fuel flow at the gas valve or the pressure regulating device. The pressure regulating device is itself a complex component requiring precise adjustment upon installation, and often requires periodic maintenance of an equally precise nature. Such precision is required for it to mix fuel and air in response to both the blower air pressure and the supplied fuel pressure. Power burner systems also disadvantageously consume electricity to drive the centrifugal blower and to operate the pressure regulator in addition to the consumption of gaseous fuel. Centrifugal blowers consume greater amounts of electrical energy than do simple propeller fans, but are used in order to meet the pressure requirements of the power burner as well as to drive the venting flow. Furthermore, if a direct vent system is not provided and combustion air is thus drawn from the surrounding room instead of from the outdoor atmosphere, the higher pressure requirements of the power burner system will cause an even greater loss of conditioned room air than is experienced in the natural draft atmospheric burner systems described above.

It is sometimes desirable to employ the heated water from the water heater to heat room air in the building in which the water heater is installed. Water heaters having power burner systems are known to have been adapted for this purpose. Heated water is pumped from the tank in the water heater to a coil exposed to the room air, and is returned to the tank in a cycle separate from the ordinary flow of hot and cold potable water through the water heater and associated plumbing. The coil is associated with an existing space heating system at an air duct or radiator. Such attempts to provide a combination water heater-space heater thus require plumbing connections to be made through the room space between the water heater and the existing space heating system, and disadvantageously occupy and limit available room space in utility rooms or other similarly cramped indoor locations where these appliances must be installed.

Disadvantages common to both atmospheric burner and power burner systems include the location of the gas valve and associated components at the exterior of the water heater body. Exposure of these components could subject them to damage upon shipment or installation, or to improper adjustment by untrained personnel after installation. These components also present a somewhat inappropriate appearance for a finished basement or other common household location of a water heater.

Known water heaters are thus seen to fail to provide a venting system which efficiently operates in isolation from indoor room air without requiring the use of complex electrical components such as fluid pressure regulators and energy consuming centrifugal blowers, or to provide an unobtrusive and compact arrangement of components to serve as a combination water heater and space heater.

SUMMARY OF THE INVENTION

The present invention overcomes the above-referred to disadvantages and others and provides an indoor domestic type gas water heater having a forced draft direct vent system for an atmospheric burner, and which is adaptable for use as a combination water heater and space heater in a compact arrangement of components.

In accordance with a principal feature of the invention there is provided an indoor domestic type gas water heater having an atmospheric burner associated with a combustion chamber for heating of water stored in the water heater tank. A housing is provided at the exterior of the water heater to define an air pressure chamber between the housing walls and the exterior body wall of the water heater. The air pressure chamber has a first opening communicating with the exterior of the housing, and a second opening communicating with the combustion chamber of the water heater. A combustion air fan is associated with the first opening in the air pressure chamber to pressurize the chamber and is operated in response to a thermostat in the water tank. An air pressure sensing means is provided to controllably permit a supply of gaseous fuel to reach the atmospheric burner, and to activate a fuel igniter in response to pressurization of the air pressure chamber as caused by the combustion air fan. A forced draft system for the atmospheric burner is thereby provided as the combustion air fan forces a pressurized flow of combustion air at the second opening of the air pressure chamber inwardly to the combustion chamber. This flow provides both the needed oxygen at the atmospheric burner and the draft required to drive the forced draft system. The air pressure within the housing also serves as an operating parameter of the water heater, as the combustion of fuel is initiated in response to a threshold level of pressure in the air pressure chamber as caused by the combustion air fan, which in turn is responsive to a minimum temperature level detected by the thermostat.

In accordance with a more specific feature of the invention the combustion air fan is provided in the form of a propeller fan within the housing at a position adjacent the first opening. A propeller fan is sufficient to pressurize the housing and thus simplifies the system in comparison to known forced draft systems employing a centrifugal blower.

In accordance with another specific feature of the invention the combustion chamber is a submerged type combustion chamber which extends into the water tank through an access opening in the upright exterior wall of the water heater. The housing is positioned to cover the access opening and further encloses the components of the heating system which extend in whole or in part into the combustion chamber through the access opening. The housing protects these components, which normally will include an adjustable gas valve in addition to the atmospheric burner, and provides an outward appearance simply as a protruding portion of the overall water heater exterior contour.

In accordance with a further specific feature of the invention, there is provided an inlet conduit means communicating the first opening of the air pressure chamber with the outdoor atmosphere. The venting system is thereby made to be a direct vent system whereby the combustion chamber is vented to the outdoor atmosphere in isolation from indoor room air.

In accordance with other specific features of the invention, an outlet conduit means extends from the open upper end of the flue pipe of the water heater to the outdoor atmosphere. The outlet conduit means may include a flue collector box received over the upper end of the flue pipe to make an air flow connection between the flue pipe and a conduit extending horizontally away from the flue collector box. This arrangement allows placement of an air handler assembly at a position mounted vertically above the water heater. The air handler assembly includes a coil in a closed cycle water line extending between the water heater tank and the air handler assembly and is adapted to provide a pressurized flow of indoor room air across the coil. The invention thus enables an arrangement of components to serve as a combination forced draft water heater and space heater in a continuous upright configuration which does not excessively occupy room space.

In accordance with another principal feature of the invention, there is provided a combination water heater and space heater comprised of an indoor domestic type water heater having an upright cylindrical body, and a space heating means adapted to conduct heat from the heated water to indoor room air. The water heater has an atmospheric burner and means to provide a forced draft direct vent system communicating the atmospheric burner with the outdoor atmosphere. The space heating means includes an air handler assembly mounted at the top of the water heater body. The combination water heater and space heater is thus constructed in a compact and space saving arrangement of vertically aligned components.

In accordance with yet another principal feature of the invention there is provided a forced draft control system for an indoor domestic type water heater comprising a combustion air fan adapted to provide a forced draft in response to a water temperature thermostat, and a heating means, including an atmospheric burner, adapted to operate in response to air pressure generated by the fan. The invention thus provides a simplified forced draft control system without the need for complex components designed to monitor and respond to gas flow pressure in a power burner.

In accordance with a more specific feature of the invention, the heating means of the forced draft control system includes a gas valve adapted to controllably supply fuel to the atmospheric burner, and an igniter adapted to ignite combustion at the burner. The igniter operates in response to air pressure generated by the fan, and the gas valve in turn operates in response to the igniter. The control system thus initiates combustion of the atmospheric burner in the presence of a forced draft.

In accordance with a further specific feature of the invention, the heating means of the control system is partially contained within the water heater body at the combustion chamber and partially disposed outside the water heater body. A control system housing is provided over the outside portion of the heating means, and defines an air pressure chamber which is open both to the combustion chamber and to the exterior of the housing. The combustion air fan is adapted to pressurize the air pressure chamber. The housing thereby directs the forced draft caused by the fan from the exterior thereof to the combustion chamber, provides an air pressure zone in which the heating means may respond to the draft to control combustion accordingly, and protects and conceals the otherwise exposed components of the system.

In accordance with still another specific feature of the invention, an air pressure sensing means is provided within the air pressure chamber and is adapted to operate the igniter in response to that air pressure.

In accordance with yet another specific feature of the invention the combustion air fan is provided as a propeller fan within the control system housing adjacent the opening to the housing exterior. The invention thus provides a forced draft control system comprised of simplified components.

In accordance with another principal feature of the invention, there is provided a method of operation of a gas fueled water heater which is vented along an air flow path extending through a combustion chamber in which a burner is disposed. The method includes the steps of causing the venting draft to flow in response to detection of a low water temperature, and initiating combustion of fuel at the burner in response to air pressure developed by the draft.

In accordance with a more specific feature of the invention, a housing structure is provided at the exterior of the water heater to define an air pressure zone in which the draft pressure is sensed to initiate combustion. Other specific features include the use of a forced draft which both vents the heater and pressurizes the interior of the housing to initiate combustion, and the use of a propeller fan within the housing to cause the draft.

The principal object of the present invention is to provide an improved indoor domestic type water heater having a forced draft direct vent system for an atmospheric burner.

Another object of the present invention is to provide a combination gas water heater and space heater in a compact arrangement of component parts.

Another object of the present invention is to provide a forced draft system for a gas water heater having an atmospheric burner which minimizes the complexity of the component parts and reduces the demand for electrical energy.

Still another object of the present invention is to provide an improved and simplified control system and method for operating a gas water heater.

These and other objects of the invention will become apparent from the following detailed description of a preferred embodiment thereof and from the accompanying drawings.

BRIEF DESCRIPTION OF THE DRAWINGS

In the drawings:

FIG. 5 is a front elevational view of the water heater shown in FIG. 1 as adapted as a combination water heater and space heater in accordance with the present invention;

FIG. 6 is a side elevational view of the combination water heater and space heater shown in FIG. 5: and, FIG. 7 is a top plan view of the combination water heater and space heater shown in FIG. 5.

DESCRIPTION OF A PREFERRED EMBODIMENT

Figure 2:
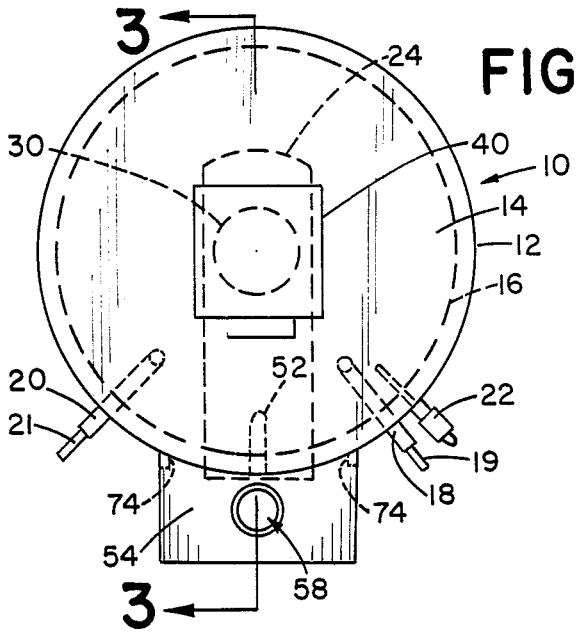
FIG. 2 is a top plan view of the water heater shown in FIG. 1.
Figure 1:
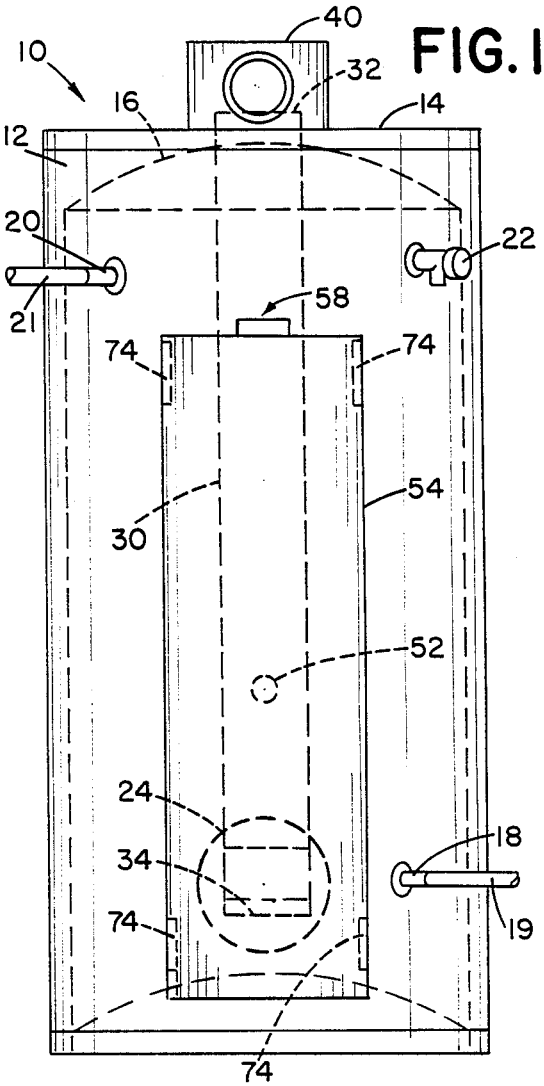
FIG. 1 is a front elevational view of a water heater constructed in accordance with the present invention.

Referring now to the drawings wherein the showings are for the purposes of illustrating a preferred embodiment of the invention only and not for the purpose of limiting same, in FIG. 1 there is shown a front elevational view of a water heater constructed in accordance with the present invention. The water heater 10 has a generally elongated upright exterior contour defined by a cylindrical exterior wall 12 and a generally flat top surface 14, and includes a tank 16 adapted to store a quantity of water to be heated, a cold water inlet 18 fed by a cold water source line 19, a hot water outlet 20 feeding a potable hot water line 21, a pressure relief valve 22, and a combustion chamber 24 associated with the tank 16 to conduct heat of combustion to the stored water. In the preferred embodiment the combustion chamber 24 is a submerged type combustion chamber as disclosed in U.S. Pat. No. 4,660,541 which is incorporated herein by reference. The combustion chamber 24 includes an inlet opening 26 and a outlet opening 28. A flue pipe 30 extends from the outlet opening 28 vertically through the tank 14 to an open upper end 32 at the top surface 14 of the water heater 10. The flue pipe 30 includes a lower end 34 extending downwardly into the combustion chamber 24 and having a flue gas inlet opening 36 facing in a direction away from the combustion chamber inlet opening 26 as shown. The flue pipe 30 may include baffles 38 in a conventional manner. A flue collector box 40 is provided over the open upper end 32 of the flue pipe 30 to define an air flow passageway between the flue pipe 30 and an outlet conduit means to be described in detail hereinafter with reference to FIG. 4.

Figure 3:
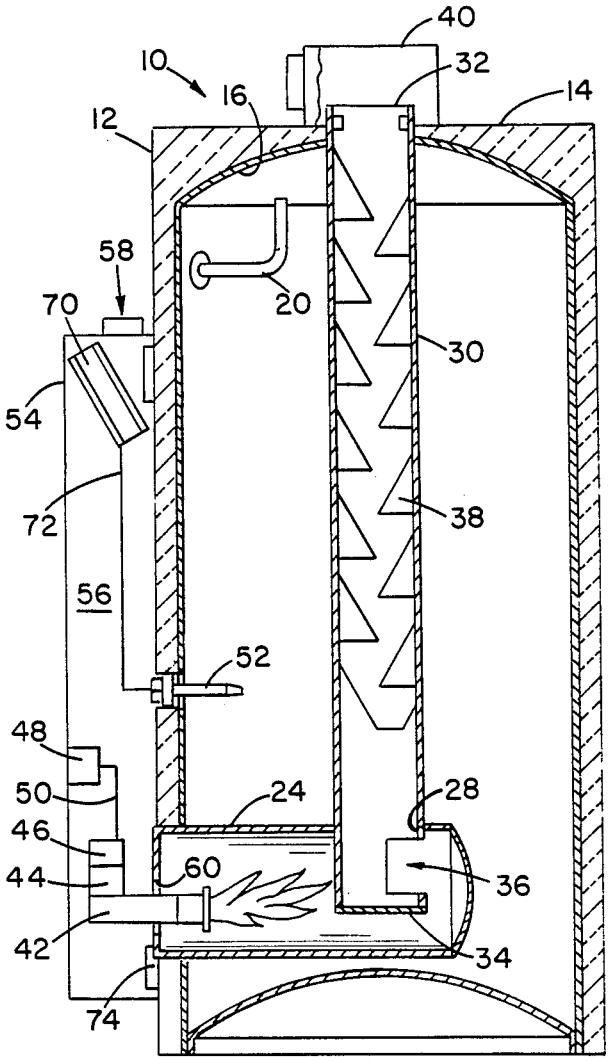
FIG. 3 is a cross-sectional view taken on line 3—3 of FIG. 2.

A combustion means is provided to include an atmospheric burner, a gas valve, and a gas igniter. An atmospheric burner 42 extends into the combustion chamber 24 through the combustion chamber inlet opening 26. Shown schematically in FIG. 3 is a gas valve 44 adapted to controllably permit a flow of gaseous fuel from a source (not shown) to the atmospheric burner 42. The atmospheric burner 42 has an air opening (not shown) into which surrounding atmospheric combustion air is drawn by the flowing gaseous fuel for mixture therewith. Also shown schematically in FIG. 3 is an igniter 46 adapted to ignite the mixture of fuel and air. The igniter 46 may also serve as a flame detector as part of a safety shut-down system in a known manner. Also shown schematically in FIG. 3 is an air pressure sensor 48 which is operatively connected to the combustion means through a first electrical connection 50. A water temperature thermostat means 52 extends through the exterior body wall 12 into the tank 14.

A housing 54 is positioned at the side of the water heater 10 to define an air pressure chamber 56 in part by the housing walls as shown, and in part by the exterior body wall 12 of the water heater 10. The air pressure chamber 56 has a first opening 58 communicating with the exterior of the housing 54, and a second opening 60 communicating the air pressure chamber 56 with the combustion chamber 24. The second opening 60 of air pressure chamber 56 preferably coincides with the combustion chamber inlet opening 26. As shown in the figures, the housing 54 encloses the atmospheric burner 42, the gas valve 44, the igniter 46, the pressure sensor 48, and the thermostat means 52. Disposed within the housing 54 adjacent the first opening 58 is a combustion air propeller fan 70. The fan 70 is operatively connected to the thermostat means 52 by a second electrical connection 72. To provide service access to the enclosed components, the housing 54 may be releasably attached to the water heater exterior body wall 12 by vertical sliding brackets 74 or other releasable fastening means, or may be more securely attached, such as with machine screws. Alternately, an access panel could be provided in the housing. Gaskets may be provided as required.

Operation of the forced draft system is initiated when the thermostat means 52 detects a minimum or a low water temperature within the tank 14. The thermostat means 52 then causes the combustion air fan 70 to draw air in through the first opening 58 thereby to pressurize the air pressure chamber 56. The air pressure sensor 48 responds to a predetermined level of increased pressure within the air pressure chamber 56 to activate operation of the combustion means, which energizes the igniter 46 and opens the gas valve 44, preferably after an igniter warm-up period. A forced draft proceeds as combustion air flows through the air pressure chamber 56 into the combustion chamber 24, and as the flue gases and heated combustion air are driven out of the combustion chamber 24 through the flue pipe 30 to the flue collector box 40 at the top of the water heater 10. The thermostat means 52 shuts down the combustion air fan 70 upon detection of a predetermined elevated water temperature, thus causing a reduction in pressure within the air pressure chamber 56. The air pressure sensor 48 then responds to the reduced pressure to shut down the combustion means until the heating cycle is repeated.

Figure 4:
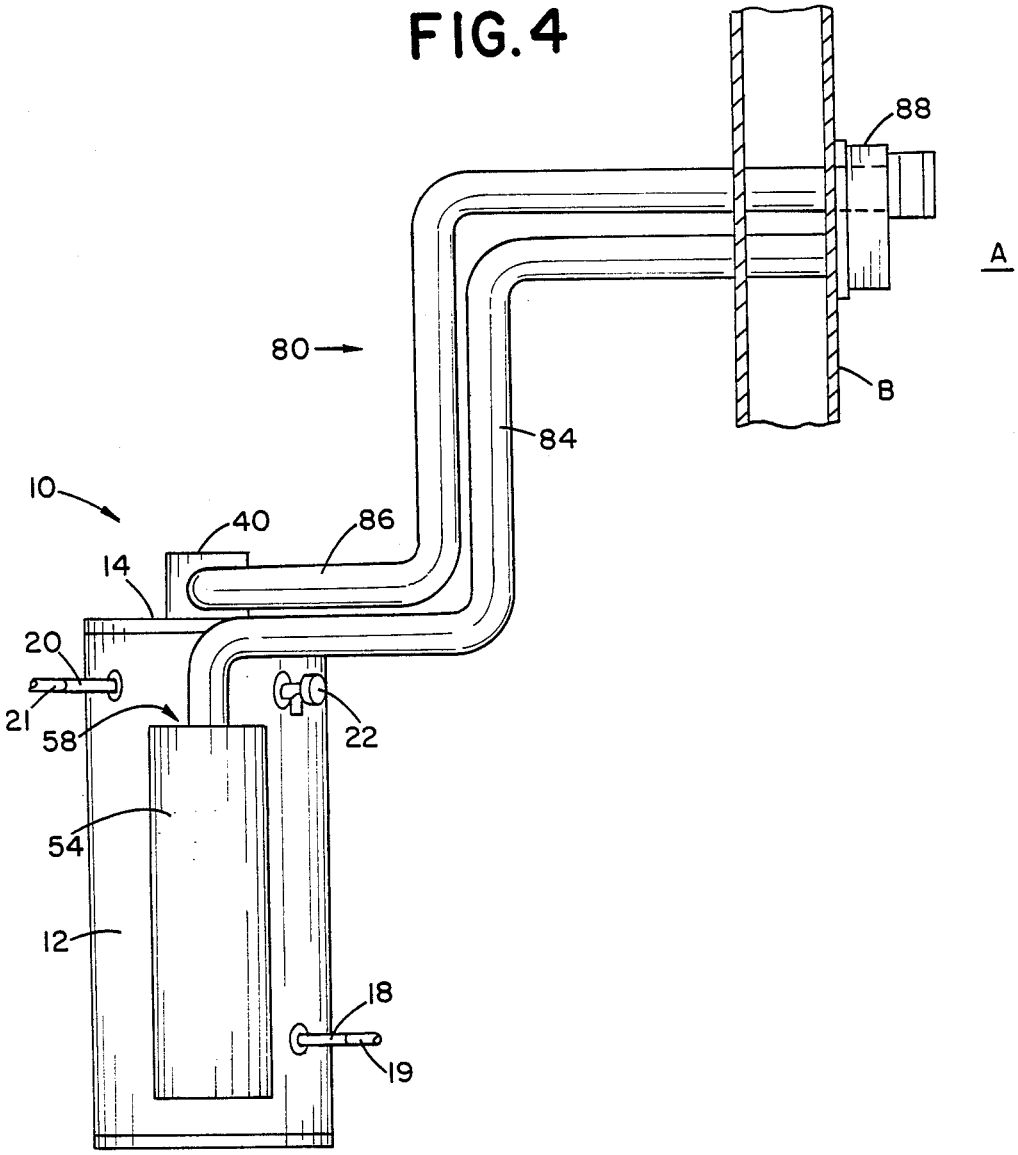
FIG. 4 is a front elevational view of the water heater shown in FIG. 1 as provided with a forced draft direct vent system in accordance with the present invention.

As shown in FIG. 4, the water heater 10 is provided with a direct vent system including a conduit assembly 80 extending from the water heater 10 through an exterior building wall B to the outdoor atmosphere A. The conduit assembly 80 comprises an outlet conduit 82 communicating the flue collector box 40 with the outdoor atmosphere A, and an inlet conduit 84 communicating the outdoor atmosphere A with the first opening 58 of the housing 54. The outlet conduit 82 includes a horizontal outlet conduit section 86 extending from the flue collector box 40 to a position spaced away from the exterior body wall 12 of the water heater 10. The inlet conduit 84 likewise extends laterally away from the water heater 10 before turning vertically upward as shown. The outlet conduit 82 and the inlet conduit 84 separately communicate with the outdoor atmosphere A at a common vent terminal 88.

As shown in FIGS. 5 through 7, the water heater 10 may be adapted as a combination water heater and space heater in accordance with the present invention. An air handler 100 is mounted atop the water heater 10 on a framework comprising brackets 101. The horizontal outlet conduit section 86 extends from the flue collector box 40 beneath the air handler 100. The air handler 100 is provided with a hot water coil connection 102 and a cold water coil connection 104. A hot water coil 103 within the air handler 100 is in a water line communicating the hot water coil connection 102 with the cold water coil connection 104. A coil supply line 106 extends from the hot water outlet 20 at the water heater 10 to the hot water coil connection 102 at the air handler 100 separately from the potable hot water line 21 and includes a pump 108. A coil return line 110 extends from the cold water coil connection 104 at the air handler 100 to the cold water inlet 18 at the water heater 10 separately from the cold water source line 19. A duct opening 112 at the top of the air handler 100 is adapted for connection to the duct work of the space heating system of the building in which the combination water heater and space heater is installed. Also included within the air handler 100 and not shown in the drawings is an air blower adapted to draw indoor room air into the air handler 100 through the duct opening 112 and to cause a pressurized flow of the indoor room air across the hot water coil. The combination water heater and space heater thus provides a source of heat for indoor room air at the hot water coil which is brought to an elevated temperature by circulation of hot water through the combined components by the pump 108.

The invention has been described with reference to a preferred embodiment. Obviously, modifications and alterations will occur to others upon the reading and understanding of the specification. It is intended to include all such modifications and alterations insofar as they may come within the scope of the appended claims and the equivalence thereof.

Having thus defined the invention, it is claimed:

1. An indoor domestic type gas water heater having a forced draft venting system and comprising:
   an upright exterior body wall;
   a tank for containing a quantity of water to be heated;
   thermostat means responsive to the temperature of said water;
   an atmospheric burner;
   fuel supply means adapted to controllably supply gaseous fuel from a supply source to said atmospheric burner;
   igniter means adapted to ignite said fuel supplied to said burner;
   a combustion chamber adapted to convey heat of combustion from said burner to said water;
   a housing associated with the exterior of said water heater to provide an air pressure chamber defined in part by said exterior body wall and in part by walls of said housing, said air pressure chamber having a first opening communicating with the exterior of said housing, and a second opening communicating with said combustion chamber;
   a combustion air fan operatively associated with said first opening in said air pressure chamber to move air into said air pressure chamber and to increase the air pressure within said chamber to a value greater than the air pressure within said chamber when said fan is not operating, said fan being responsive to said thermostat means; and,
   pressure sensing means adapted to detect said increased air pressure in said air pressure chamber and to activate said fuel supply means and said igniter means in response to said increased air pressure.

2. A water heater as defined in claim 1 wherein said fan is a propeller fan within said housing adjacent said first opening.

3. A water heater as defined in claim 1 wherein said combustion chamber is a submerged type combustion chamber extending into said tank through an access opening in said exterior wall; said housing covers said access opening; and said fuel supply means is disposed outside said exterior wall and within said housing.

4. A water heater as defined in claim 1 further comprising inlet conduit means communicating said first opening of said air pressure chamber with the outdoor atmosphere.

5. A water heater as defined in claim 1 further comprising a flue pipe extending from said combustion chamber to an open end atop said water heater body; and outlet conduit means communicating said open end of said flue pipe with the outdoor atmosphere.

6. A water heater as defined in claim 5 further comprising inlet conduit means communicating said first opening of said air pressure chamber with the outdoor atmosphere.

7. A water heater as defined in claim 5 further comprising a flue collector box defining an air flow passageway between said open end of said flue pipe and said outlet conduit means.

8. A water heater as defined in claim 7 wherein said outlet conduit means includes a first section extending horizontally from said flue collector box to a position beyond said exterior body wall of said water heater; and further comprising room heating means adapted to conduct heat from said water in said tank to indoor room air, said room heating means comprising an air handler assembly mounted to said water heater body at a position vertically above said flue collector box.

9. A water heater as defined in claim 8 wherein said air handler assembly is mounted on said water heater body by means of brackets to define a space between said air handler assembly and said water heater body through which said first section of said outlet conduit assembly extends.

10. A water heater as defined in claim 8 wherein said room heating means comprises a closed cycle water line communicating said tank in said water heater with said air handler assembly, said closed cycle water line including a coil within said air handler assembly and,
   said air handler assembly is adapted to cause a pressurized flow of said indoor room air across said coil.

11. A combination water heater and space heater comprising:
   an indoor domestic type water heater having an upright cylindrical body, an atmospheric burner, means to provide a forced draft direct vent system communicating said burner with the outdoor atmosphere both to provide combustion air and to expel flue gases, a flue pipe terminating at an open end atop said upright cylindrical body, and an outlet conduit assembly communicating said open end of said flue pipe with the outdoor atmosphere, said outlet conduit assembly including a first section extending horizontally from said open end of said flue pipe to a position laterally spaced from said body; and,
   space heating means adapted to conduct heat from water heated by said water heater to indoor room air, said space heating means comprising an air handler assembly mounted at the top of said water heater body, a water line in a closed cycle communicating said water heater with a hot water coil in said air handler assembly, said air handler assembly being adapted to cause a pressurized flow of indoor air over said coil, and said air handler assembly being mounted on said water heater body by means of brackets to define a space between said air handler assembly and said water heater body through which said first section of said outlet conduit assembly extends.

12. A combination water heater and space heater as defined in claim 11, wherein said first section of said outlet conduit assembly includes a horizontal duct and a flue collector box, said flue collector box being received over said open end of said flue pipe to define an air flow passageway between said open end of said flue pipe and said horizontal duct.

13. A forced draft control system for an indoor domestic type water heater including a tank of water and a thermostat responsive to the temperature of said water, said forced draft control system comprising:
   a combustion air fan adapted to provide a forced draft for said water heater and to be operatively responsive to said thermostat;
   heating means operatively responsive to said forced draft and including an atmospheric burner adapted to burn gaseous fuel, a gas valve adapted to controllably supply gaseous fuel from a supply source to said atmospheric burner, and an ignitor adapted to ignite combustion of said gaseous fuel at said burner, said ignitor being operatively responsive to said forced draft and said gas valve being operatively responsive to said ignitor; and, said water heater having an exterior body wall and an interior combustion chamber, said heating means extending from an interior position within said combustion chamber to an exterior position outside of said exterior body wall, and a control system housing associated with the exterior of said water heater to provide an air pressure chamber defined in part by said exterior body wall and in part by walls of said housing, said air pressure chamber having a first opening communicating with the exterior of said housing, and a second opening communicating with said combustion chamber, said housing enclosing said portion of said heating means extending to the exterior of said water heater, with said combustion air fan being adapted to move air in through said first opening to increase the air pressure within said chamber to a value greater than the air pressure within said chamber when said fan is not operating.

14. A forced draft control system as defined in claim 13, further including air pressure sensing means responsive to the air pressure within said air pressure chamber; said igniter being operatively responsive to said air pressure sensing means.

15. A forced draft control system as defined in claim 13, wherein said combustion air fan is a propeller fan within said housing adjacent said first opening.

16. A combination water heater and space heater comprising:

an indoor domestic type water heater having an upright cylindrical body, an atmospheric burner, means to provide a forced draft direct vent system communicating said burner with the atmosphere both to provide combustion air and to expel flue gases, said means to provide a forced draft direct vent system comprising a housing associated with the exterior of said water heater body to provide an air pressure chamber defined in part by said water heater body and in part by walls of said housing, said air pressure chamber having a first opening communicating with the exterior of said housing, and a second opening communicating with said combustion air inlet passage, a combustion air fan operatively associated with said first opening to move air into said air pressure chamber, and an inlet conduit assembly extending from said first opening to the outdoor atmosphere; and, space heating means adapted to conduct heat from water heated by said water heater to indoor room air, said space heating means comprising an air handler assembly mounted at the top of said water heater body.

17. A combination water heater and spacer heater comprising:

a water heater having a top end, a cold water inlet, and a hot water outlet;

an air handler assembly comprising a housing, a water line including a hot water coil connection opening to the exterior of said housing, a coil supply line communicating said hot water outlet with said hot water coil connection, a cold water coil connection opening to the exterior of said housing, a coil return line communicating said cold water inlet with said cold water coil connection, a coil within said housing communicating said hot water coil connection with said cold water coil connection, a duct opening communicating the exterior of said housing with the surface of said coil, and a blower adapted to move air into said housing through said duct opening and across said coil, said housing being mounted to said top end of said water heater;

said water heater further comprising an upright cylindrical body, a flue pipe terminating at an open end atop said upright cylindrical body, and an outlet conduit assembly communicating said open end of said flue pipe with the outdoor atmosphere, said outlet conduit assembly including a first section extending horizontally from said open end of said flue pipe to a position laterally spaced from said body.

18. A combination water heater and space heater as defined in claim 17 wherein said housing of said air handler assembly is a rectangular box mounted atop said upright cylindrical body of said water heater by means of brackets to define a space between said housing and said water heater body through which first section of said outlet conduit assembly extends.

19. A control system for an indoor domestic type water heater including a tank of water and a gas fuel burner, said control system comprising:

thermostat means for detecting the temperature of said water;

fan means for providing a draft for said burner, said fan means being directly responsive to said thermostat means to initiate said draft when said thermostat means detects a predetermined first temperature and to terminate said draft when said thermostat means detects a predetermined second temperature;

gas supply means for providing fuel to said burner and having an open condition permitting fuel flow to said burner and a closed condition blocking said flow;

ignitor means for igniting said fuel delivered to said burner; and, air pressure sensing means for controlling said gas supply means and said ignitor means, said air pressure sensing means being adapted to detect and respond to said draft to shift said gas supply means into said open condition and to cause said ignitor means to ignite said fuel when said draft is initiated, and to shift said gas supply means into said closed condition when said draft is terminated.

20. A control system as defined in claim 19 wherein said burner is an atmospheric burner extending within a combustion chamber.

21. A control system as defined in claim 20 further including an air pressure chamber having an inlet opening, and an outlet opening communicating with said combustion chamber; and wherein said fan means is adapted to cause said draft to flow into said air pressure chamber through said inlet opening and out of said air pressure chamber through said outlet opening; and said air pressure sensing means detects and responds to said draft within said air pressure chamber.

22. A control system as defined in claim 21 wherein said air pressure chamber is defined by the interior of a housing structure disposed at the exterior of said water heater.

23. An indoor domestic type gas water heater having a direct vent system and comprising:

a tank for containing a quantity of water to be heater;

thermostat means responsive to the temperature of said water;

an atmospheric burner;

fuel supply means for controllably supplying gaseous fuel from a supply source to said atmospheric burner;

ignitor means for igniting said fuel supplied to said burner;

a combustion chamber adapted to convey heat of combustion from said burner to said water;

an air pressure chamber having an inlet opening and an outlet opening communicating with said combustion chamber;

a combustion air fan operatively associated with said inlet opening in said air pressure chamber to move air into said air pressure chamber and to increase the air pressure within said chamber to a value greater than the air pressure within said chamber when said fan is not operating, said fan being responsive to said thermostat means; and, pressure sensing means for detecting said increased air pressure in said air pressure chamber and to activate said fuel supply means and said ignitor means in response to said increased air pressure.

24. A water heater as defined in claim 23 wherein said heater has an outer cylindrical body wall and said air pressure chamber is defined by a housing disposed at the exterior of said body wall.

25. A water heater as defined in claim 24 wherein said combustion chamber has an air inlet opening communicating said combustion chamber with the exterior of said body wall, and said housing encloses said opening to define a combustion air path extending from said air pressure chamber into said combustion chamber through said opening.

* * * * *

UNITED STATES PATENT AND TRADEMARK OFFICE

CERTIFICATE OF CORRECTION

PATENT NO. : 4,925,093

DATED : May 15, 1990

INVENTOR(S) : Henry J. Moore, Jr. ; Wouter J. Wiersma

It is certified that error appears in the above-identified patent and that said Letters Patent is hereby corrected as shown below:

Claim 17, line 1, "spacer" should read --- space ---. Claim 18, line 6, after "which" insert --- said ---. Claim 23, line 3, "heater" should read --- heated ---.

Signed and Sealed this

Third Day of March, 1992

*Attest:*

HARRY F. MANBECK, JR.

*Attesting Officer*

*Commissioner of Patents and Trademarks*